US005107631A

United States Patent [19]

Wern

[11] Patent Number: 5,107,631

[45] Date of Patent: Apr. 28, 1992

[54] ABRASIVE BLASTING APPARATUS

[75] Inventor: Michael J. Wern, Mokena, Ill.

[73] Assignee: Engineered Abrasives, Inc., Austin-Worth, Ill.

[21] Appl. No.: 704,799

[22] Filed: May 23, 1991

[51] Int. Cl.[5] ..... B24C 3/16

[52] U.S. Cl. ..... 51/410; 51/411; 51/439; 51/424; 51/281 P; 72/53

[58] Field of Search ..... 51/410, 411, 417, 439, 51/421, 424, 281 R, 281 P, 317, 319; 15/104.09, 104.01 R, 3.5 R; 72/53

[56] References Cited

U.S. PATENT DOCUMENTS

| | | | |
|---|---|---|---|
| 2,117,648 | 5/1938 | Bottorf | 51/411 |
| 4,067,150 | 1/1978 | Merrigan | 51/439 |
| 4,180,948 | 1/1980 | Stoltz | 51/411 |
| 4,423,567 | 1/1984 | Raven | 51/345 |
| 4,674,239 | 6/1987 | Jodoin | 52/424 |
| 4,934,111 | 6/1990 | Hashish et al. | 51/439 |
| 4,993,200 | 2/1991 | Morioka et al. | 51/424 |

FOREIGN PATENT DOCUMENTS

| | | | |
|---|---|---|---|
| 753030 | 11/1977 | Fed. Rep. of Germany | 51/411 |

*Primary Examiner*—Bruce M. Kisliuk
*Assistant Examiner*—Eileen P. Morgan
*Attorney, Agent, or Firm*—Trexler, Bushnell, Giangiorgi & Blackstone

[57] ABSTRACT

A nozzle for sandblasting or shot peening a workpiece comprises a base and a finger, The finger having diameter small enough to allow it to be inserted into an aperture in the workpiece. The finger has a lateral opening therein to allow peening fluid to exit and impinge an interior wall of the aperture. The base has a bypass orifice therein which allows excess shot to exit the nozzle so that the nozzle will not clog with shot. A method for using the nozzle is contemplated wherein the nozzle is reciprocated and rotated within the aperture so as to subject the entire interior wall to the peening process.

9 Claims, 1 Drawing Sheet

ABRASIVE BLASTING APPARATUS

BACKGROUND AND SUMMARY OF THE INVENTION

This invention relates generally to a unique abrasive blasting apparatus and method for shot peening, or sandblasting, small apertures in workpieces. More specifically, the invention relates to improvements in the design of nozzles employed by such peening devices. With the use of these devices, it is desired to subject the interior wall of an aperture of small diameter to the treatment of sandblasting, or shot peening.

Many modern workpieces have apertures having an extremely small diameters. A turbine manifold used in a jet engine is one example of such a workpiece. The proper operation of such workpieces depends, in part, upon the condition of the workpiece surfaces, including the surfaces of the small apertures, thus making a peening treatment necessary. However, the small sizes inherent in such a peening process present an obstacle to effective peening. Also, the forces present in peening can lead to damage of the workpiece.

In the peening apparatus designs and methods currently available, a straight peening nozzle is aligned with an aperture in the workpiece, so that the nozzle can direct a stream of shot axially into the aperture. To direct the shot against the interior wall of an aperture, a conical or beveled deflector is inserted into the aperture from the direction opposite to that of shot flow. As the shot encounters the deflector, the shot is directed against the interior wall of the aperture. The deflector then is reciprocated within the aperture so that shot encounters all areas of the interior wall of the aperture.

Using the currently available peening methods and apparatuses, problems with the peening process often arose. Because the deflector encountered the direct stream of shot flow, the deflector rapidly wore out. Further, as the deflector wore, the distribution of shot was unpredictable, and inaccurate. Also, pieces of shot could become wedged between the deflector and the interior wall of the aperture. Therefore, when the deflector was translated into or out of the aperture, the interior wall of the aperture would be damaged by the shot being compressed between the deflector and the interior wall, thereby deforming the wall. This was a significant drawback, the adverse effects of which were increased by the practice of reciprocating the deflector within the aperture during the peening process.

Given these adverse effects, and the continued need for subjecting workpieces to the peening treatment, a more effective peening apparatus and method is needed. Because of the small diameter of the apertures in the workpieces, the space in which to work is at a premium. Specifically, a shot peening device, and the method for using that device, must be designed to operate effectively in those close quarters without damaging the workpiece. This is no easy task considering the size of the shot, the diameter of the aperture, the size and configuration of the nozzle which directs the shot, and the accumulation of the shot after the shot has left the nozzle.

OBJECTS AND SUMMARY OF THE INVENTION

A general object of the present invention is to provide a method and apparatus capable of directing shot against the interior wall of a small aperture without the need of a deflector so that the apparatus will not become clogged with shot during operation.

Another object of the invention is to provide an abrasive blasting apparatus for use in shot peening workpieces which has a nozzle having a lateral opening through which shot can travel.

A further object of the invention is to provide an abrasive blasting apparatus for use in shot peening workpieces that has a nozzle constructed so as to prevent clogging of the nozzle with shot.

An additional object of the invention is to provide an abrasive blasting apparatus and peening method which can direct shot against the entire interior wall of an aperture.

Another object of the present invention is to provide a nozzle for use with an abrasive blasting apparatus and peening method for directing shot into a small diameter aperture while maintaining a high velocity of the shot.

An additional object of the invention is to provide an abrasive blasting apparatus and peening method whereby a nozzle is reciprocated into and out of an aperture in a workpiece and simultaneously is rotated within the aperture during the peening process so that a lateral opening in the nozzle confronts all portions of an interior wall of the apertures.

A nozzle, constructed according to the teachings of the present invention, has a base and a finger. The finger depends from the base, and is of a diameter small enough to be insertable into an aperture in a workpiece. A bypass vent is disposed in the base, which allows excess shot to be discharged from the nozzle, so that the nozzle will not clog with shot. The finger has a lateral opening therein which directs the shot against the interior wall of an aperture in a workpiece.

The nozzle comprises part of a large abrasive blasting apparatus possessing a shot source, a mixer, a compressed air source, a piston capable of moving the nozzle up and down, and of rotating the nozzle, and a shot collector which recycles the shot.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
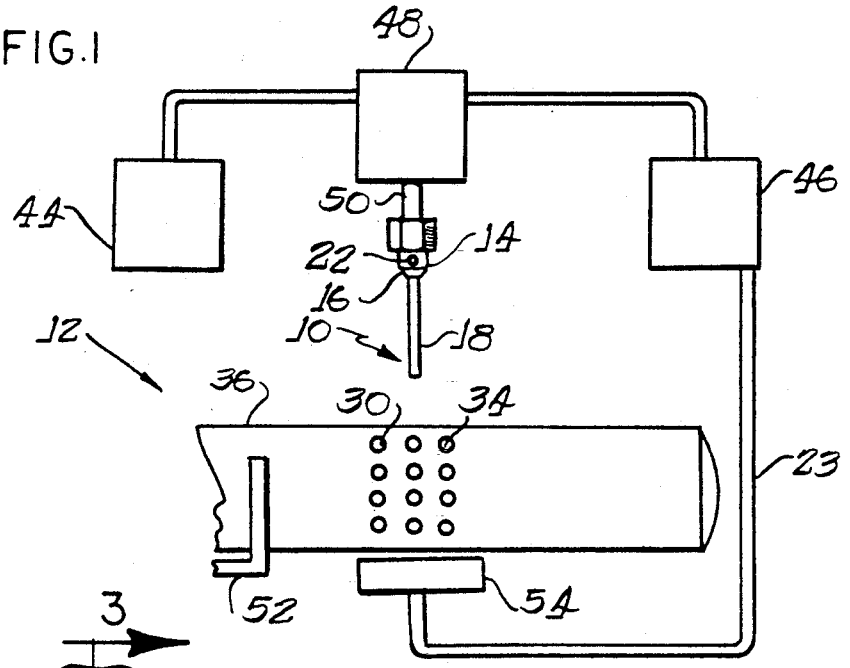
FIG. 1 is an elevational view of an abrasive blasting apparatus possessing a nozzle, constructed according to the teachings of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
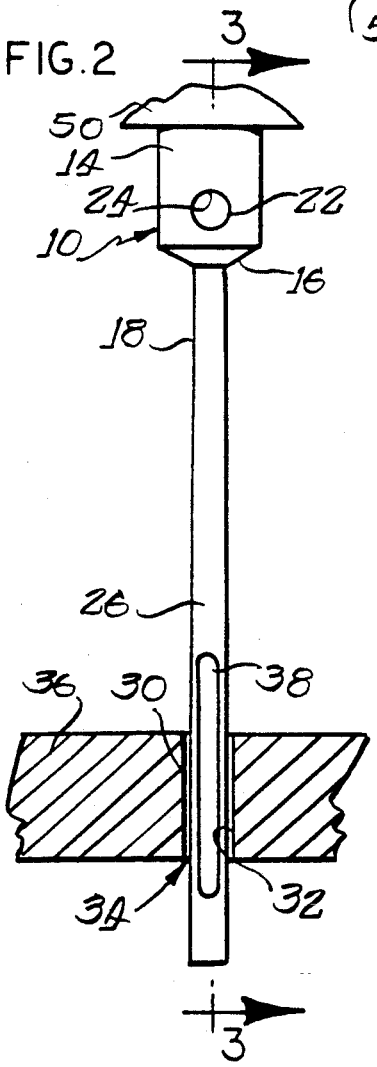
FIG. 2 is a magnified elevational view of the nozzle in FIG. 1, showing the unique construction and design thereof.

Referring to FIG. 2, a nozzle 10 for use with an abrasive blasting apparatus 12 is shown. The nozzle 10 is composed of a strong, abrasive resistant material, such as tungsten carbide, and the like, in order to withstand the forces present during peening, and to enable the nozzle 10 to function effectively during the peening process. The nozzle 10 comprises a base 14, a conical section 16, and an elongated finger 18. The base 14 terminates at the conical section 16, and the conical section 16 extends from the base 14 to the finger 18. In this fashion, the finger 18 depends downwardly from the base 14 and the conical section 16.

Figure 3:
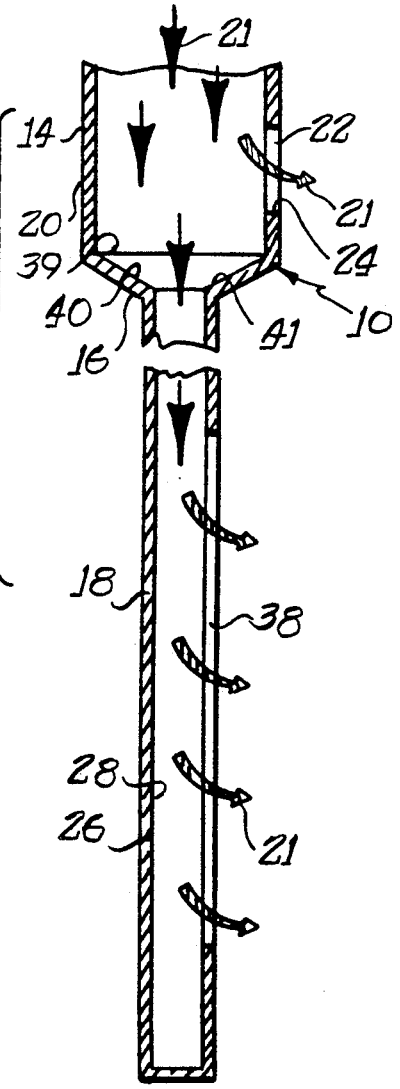
FIG. 3 is an enlarged sectional view, taken along line 3—3 of FIG. 2, showing the internal construction of the nozzle.

As shown in FIG. 3, the base has an inner diameter or bore 20 which defines part of a path of shot flow or bore means 21. The path of shot flow 21 has a first section having a first diameter, and a second section having a second diameter, which is smaller than the first diameter. The path of shot flow 21 is depicted by the arrows in FIG. 3. Venting means, or a bypass orifice or port 22, the operation of which will become apparent herein, is disposed through the base 14 of the nozzle 10 so that shot can travel therethrough to reach the exterior of the nozzle 10. The bypass orifice 22 has a diameter 24 of a size greater than twice a diameter of a shot particle so that the bypass orifice 22 cannot become clogged due to bridging of the shot during peening.

The finger 18 of the nozzle 10 has an outer diameter 26 and an inner diameter or bore 28. The outer diameter 26 is smaller than a diameter 30 defining an interior wall 32 of an aperture 34 in a workpiece 36, as shown in FIG. 2. In this manner, the finger 18 is capable of insertion into the aperture 32, as is necessary for proper shot peening. The inner bore 28 defines part of the path of shot flow 21. Also, a lateral opening or slot 38 is disposed longitudinally through one side of the finger 18 of the nozzle 10. The lateral opening 38 has a width similar to the second diameter of the path of shot flow 21, and has a length greater than the second diameter. It is noted that the inner bore 28 and slot 38 terminate short of a free distal end of the finger 18 so that the bore 28 has a closed end 37. Thus, all of the shot flowing through the bore 28 is directed laterally through the opening 38 to impinge against, and to peen the interior wall 32 of an aperture 34 in a workpiece 36.

The conical section 16 also has an inner bore 40, however, the inner bore 40 is not of constant diameter throughout the conical section 16. The inner bore 40 is equal in size to the bore 20 of the base 14 at a point 39 at which the conical section 16 joins the base 14, but the inner bore 40 tapers so as to be equal in size to the inner bore 28 of the finger 18 at a point 41 at which the conical section 16 contacts the finger 18. Therefore, the inner bore 40 gradually decreases in size between the point 39 of contact between the base 14 and the conical section 16, and a point 41 of contact between the conical section 16 and the finger 18. This construction directs the shot centrally into the finger 18 along a longitudinal axis thereof.

As shown in FIG. 1, the nozzle 10 is part of a larger abrasive blasting apparatus 12. Generally, the abrasive blasting apparatus 12 comprises a compressed air source 44, a shot source 46, a mixer 48, actuation means, or a piston 50, a cradle 52, and the like, capable of transporting shot for peening to the remainder of the abrasive blasting apparatus 12.

The shot source 46 provides shot, such as sand, or other abrasive, for use in peening to the mixer 48, of known construction, which also accepts high velocity air from the compressed air source 44. The mixer 48 combines the shot with the air, so that the shot is traveling at the same, high velocity as the air. The mixer 48 then directs the shot mixed with the air towards the nozzle 10.

The piston 50 governs the position and movement of the nozzle 10. The piston 50 is capable of moving the nozzle 10 upwards, so that the blasting apparatus 12 can accept a workpiece 36, and downwards, so that the nozzle 10 can enter an aperture 34 in the workpiece 36 for peening. Also, the piston 50 can cause the nozzle 10 to reciprocate into and out of the aperture 34 during the peening process. Furthermore, the piston 50 can cause the nozzle 10 to rotate, so that all areas of the interior wall 32 of the aperture 34 can be subjected to the peening process. The base 14 of the nozzle 10 communicates with the mixer 48 so as to accept the shot mixed with the air.

A cradle 52, partially shown in FIG. 1, is constructed so as to accept, and to hold firmly a workpiece 36 in place during the peening process. Also, in order to subject all apertures 34 to the peening process, the cradle 52 is able to rotate and to translate the workpiece 36 so that the nozzle 10 can be inserted into each aperture 34.

The shot collector 54 is disposed about the workpiece 36, and serves to collect the shot after it has encountered the workpiece 36. The shot collector 54 is connected to the shot source 46 by means of a shot return tube 23 so that the shot can be recycled.

The operation of the abrasive blasting apparatus 12 will become clear in the following discussion. With the nozzle 10 in an "up" position, as shown in FIG. 1, a workpiece 36 is loaded upon the cradle 52. The cradle 52 moves the workpiece 36 into a proper position for peening. The piston 50 then moves the nozzle 10 downward so that the finger 18 of the nozzle 10 is inserted into an aperture 34 in the workpiece 36, as shown in FIG. 2.

Simultaneously, the compressed air source 44 supplies high velocity compressed air to the mixer 48, while the shot source 46 supplies shot. The mixer 48 combines the air with the shot to form a high velocity peening fluid. The mixer 48 then communicates this fluid to the base 14 of the nozzle 10.

The fluid moves through the base 14 of the nozzle 10 and encounters the conical section 16. The path of fluid flow 21 is shown by the arrows in FIG. 3. The gradually decreasing diameter 40 directs the fluid axially into the finger 18 of the nozzle 10. The presence of the gradually decreasing diameter 40 allows the high velocity of the fluid to be maintained. If too much shot is present in the fluid, or if other conditions cause an inhibition to the fluid flow, excess fluid will vent through the bypass orifice 22 in the base 14. In this manner, the fluid is kept at a high velocity, and clogging of the nozzle 10 is avoided.

The peening fluid flows through the conical section 16 to the finger 18 of the nozzle 10. As the fluid enters the finger 18, it encounters the lateral opening slot 38. The fluid exist the nozzle 10 at the lateral opening slot 38, and engages the interior wall 32 of the apertures 34 in the workpiece 36.

To subject the entire interior wall 32 of the apertures 34 to the peening process, the piston 50 moves the nozzle 10 up and down inside the aperture 34, and rotates the nozzle 10 about a central axis of the aperture 34. In this manner, the lateral opening slot 38 in the finger 18 of the nozzle 10 opposes every section of the interior wall 32, thereby allowing the peening fluid to encounter the interior wall 32 in its entirety.

After one aperture 34 has been peened effectively, the piston 50 withdraws the nozzle 10 into the "up" position, shown in FIG. 1, and the cradle 52 rotates the workpiece 36 so that another aperture 34 is in position for peening. This procedure is repeated until all of the apertures 34 in the workpiece 36 have been peened. Throughout the peening process, the shot collector 54 is operating. The shot collector 54 collects the used shot after the shot has encountered the interior wall 32 of the apertures 34, and returns the shot to the shot source 46, thereby recycling the shot.

The nozzle 10 and abrasive blasting apparatus 12, constructed according to the teachings of the present invention, is a unique improvement over the blasting apparatuses currently available. The finger 18 of the nozzle 10 has diameter 26 and bore 28 small enough so that the finger 18 can be inserted into apertures 34. The nozzle 10, by having a lateral opening slot 38 closed at one end 37, can peen an interior wall 32 of a small diameter aperture 34 effectively without the use of a deflector. This eliminates the likelihood of damage to the workpiece 36. The bypass orifice 22 prevents clogging of the nozzle 10, which has heretofore been frequent due to the small sizes inherent in the peening process.

The size of the nozzle 10 may be varied in accordance with the size of the workpiece apertures 34 to be processed. By way of example only, and to illustrate the small sizes contemplated herein, the diameter 26 of the bore 28, and the bypass orifice or port 22 may be about 0.098 inch, and the diameter of the finger bore 28 may be about 0.045 inch. The lateral opening slot 38 may have a width of about 0.035 inch, and a length of about 0.1563 inch. The shot or abrasive particles may have a diameter of about 0.0117 inch.

The apparatus 12 is capable of moving the nozzle 10 in such a manner so that the entire surface of the interior wall 32 is subjected to the benefits of the peening process. The method contemplated herein is unique in that it incorporates reciprocating and rotating the nozzle 10 within the apertures 34. Those skilled in the art will find the present invention a benefit to peening small diameter apertures.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. An apparatus for sandblasting or shot peening a workpiece having an aperture comprising: a nozzle having a longitudinally extending central axis and including a base, a conical section extending from the base, and an elongate finger longitudinally extending from the conical section; the base, the conical section, and the finger being hollow for allowing high velocity peening fluid therethrough; the finger having an outer diameter of dimensions sufficient for insertion into the aperture in the workpiece; the base having an inner diameter larger than the outer diameter of the finger; the conical section having an inner diameter gradually decreasing in size from a point of contact of the conical section with the base to a point of contact of the conical section with the finger; the finger having a longitudinally elongate lateral opening therein for allowing high velocity peening fluid to exit the nozzle; and venting means disposed on the nozzle for venting excess shot from the nozzle for preventing clogging of the nozzle and for maintaining high velocity of the peening fluid in the nozzle.

2. An apparatus as defined in claim 1 wherein the venting means comprises a bypass orifice having a diameter greater than twice a diameter of a shot particle.

3. An apparatus as defined in claim 1 wherein the nozzle is connected to actuating means for reciprocating and rotating the nozzle within the aperture.

4. An apparatus for sandblasting or shot peening an aperture in a workpiece comprising: a nozzle having a longitudinally extending central axis and including a base and an elongate finger longitudinally extending from the base; the base and finger having bore means therein for allowing high velocity peening fluid therethrough; the finger having an outer diameter of dimensions sufficient for insertion into the aperture in the workpiece; the finger having a longitudinally elongate lateral opening therein for allowing peening fluid to exit the nozzle; and venting means operatively connected to the bore means for preventing clogging of the nozzle and for maintaining high velocity of the peening fluid within the nozzle.

5. An apparatus as defined in claim 4 wherein the venting means comprises a bypass orifice having a diameter greater than twice a diameter of a shot particle.

6. An apparatus as defined in claim 4 wherein the bore means includes a first section located in the base, and a second section located in the finger; and the first section having a first diameter, and the second section having a second diameter smaller than the first diameter.

7. An apparatus as defined in claim 6 wherein the longitudinally elongate lateral opening has a width similar in size to the second diameter, and a length substantially greater than the second diameter.

8. An apparatus as defined in claim 6 wherein the second section of the bore means terminates at a closed end located on the finger.

9. A method for sandblasting or shot peening an aperture wall in a workpiece, employing an apparatus including a nozzle having a longitudinally extending central axis and including a base and an elongate finger longitudinally extending from the base, the base and finger having bore means therein for allowing high velocity peening fluid therethrough, the finger having an outer diameter of dimensions sufficient for insertion into the aperture in the workpiece, the finger having a longitudinally elongate lateral opening therein for allowing peening fluid to exit the nozzle, and venting means operatively connected to the bore means for preventing clogging of the nozzle and for maintaining high velocity of the peening fluid within the nozzle, the method comprising the steps of: inserting the nozzle into the aperture; directing high velocity peening fluid through the nozzle; ejecting the fluid from the longitudinally elongate lateral opening; reciprocating and rotating the nozzle within the aperture so that the lateral opening confronts all portions of the wall of the aperture; and venting sufficient peening fluid through the venting means for preventing clogging of the nozzle and for maintaining high velocity of the peening fluid within the nozzle.

* * * * *